US006416295B1

(12) United States Patent
Nagai et al.

(10) Patent No.: US 6,416,295 B1
(45) Date of Patent: Jul. 9, 2002

(54) VACUUM-GENERATING UNIT

(75) Inventors: Shigekazu Nagai, Tokyo; Yoshiharu Ito, Toride; Takashi Toyama, Ibaraki-ken, all of (JP)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/654,130

(22) Filed: Sep. 1, 2000

(30) Foreign Application Priority Data

Sep. 3, 1999 (JP) ..... 11-250643

(51) Int. Cl.[7] ..... F04F 5/48
(52) U.S. Cl. ..... 417/190; 417/187
(58) Field of Search ..... 417/174, 190, 417/187, 297, 186, 161; 137/270

(56) References Cited

U.S. PATENT DOCUMENTS 4,425,084 A * 1/1984 Tell ..... 417/161
4,655,692 A * 4/1987 Ise ..... 417/187
4,848,392 A * 7/1989 Ise et al. ..... 137/270
4,880,358 A * 11/1989 Lasto ..... 417/174
5,320,497 A * 6/1994 Nagai et al. ..... 417/186
5,683,227 A * 11/1997 Nagai et al. ..... 417/174
6,109,885 A * 8/2000 Micklisch et al. ..... 417/297
6,155,796 A * 12/2000 Schmalz et al. ..... 417/187
6,171,068 B1 * 1/2001 Greenberg ..... 417/174

* cited by examiner

*Primary Examiner*—Teresa Walberg
*Assistant Examiner*—Leonid M Fastovsky
(74) *Attorney, Agent, or Firm*—Paul A. Guss

(57) ABSTRACT

A first passage communicating with a compressed air supply port, a sixth passage communicating with a vacuum port, and an eighth passage communicating with an air discharge port for a solenoid-operated valve are arranged in parallel respectively. Further, a pressure fluid-supplying solenoid-operated valve, a vacuum-breaking solenoid-operated valve, a flow rate-adjusting screw, a suction filter, and a vacuum pressure switch are successively arranged in series in a main body section.

5 Claims, 7 Drawing Sheets

VACUUM-GENERATING UNIT

BACKGROUND OF THE INVENTION

1. Field of the Invention

The present invention relates to a vacuum-generating unit which is capable of supplying a negative pressure to a suction means including, for example, a suction pad.

2. Description of the Related Art

A vacuum-generating unit has been hitherto utilized as a means for supplying a negative pressure to a suction pad. Such a vacuum-generating unit generally comprises, for example, an ejector which is used to generate the negative pressure, a vacuum port which is connected in communication with a suction means such as a suction pad via a tube, a valve mechanism section which is provided with a pressure fluid-supplying solenoid-operated valve and a vacuum-breaking solenoid-operated valve for supplying and shutting off the compressed air with respect to the ejector and the vacuum port respectively, and a vacuum switch section which is used to detect the negative pressure generated at the vacuum port.

The operation of the vacuum-generating unit concerning the conventional technique as described above will be schematically explained.

The compressed air is supplied via the valve mechanism section to the ejector to generate the negative pressure. The negative pressure, which is generated by the ejector, is fed to the suction pad via the tube connected to the vacuum port. A workpiece is attracted in accordance with the action of the negative pressure generated at the suction pad. The workpiece, which is attracted and held by the suction pad, is transported to a predetermined position in accordance with a displacement action of a robot arm.

Subsequently, the workpiece, which is held by the suction pad, is disengaged therefrom when the compressed air (positive pressure) is fed from the valve mechanism section to the suction pad via the passage communicating with the vacuum port. Accordingly, the suction pad is released from the negative pressure state. As a result, the workpiece is separated from the suction pad, and it is transported to a desired position.

It has been hitherto demanded that the entire apparatus has a small size and a light weight as far as possible by reducing the dimension of the main body section in the widthwise direction substantially perpendicular to the longitudinal direction, because of the following reason. That is, for example, when a plurality of vacuum-generating units are interlocked with each other to form a manifold, if the dimension of the main body section in the widthwise direction is reduced, then it is possible to obtain a solenoid-operated valve manifold having an extremely small size and a light weight, and it is possible to effectively utilize the space of installation.

SUMMARY OF THE INVENTION

A general object of the present invention is to provide a vacuum-generating unit which makes it possible to realize a small size and a light weight by reducing the dimension of a main body section in the widthwise direction substantially perpendicular to the longitudinal direction.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
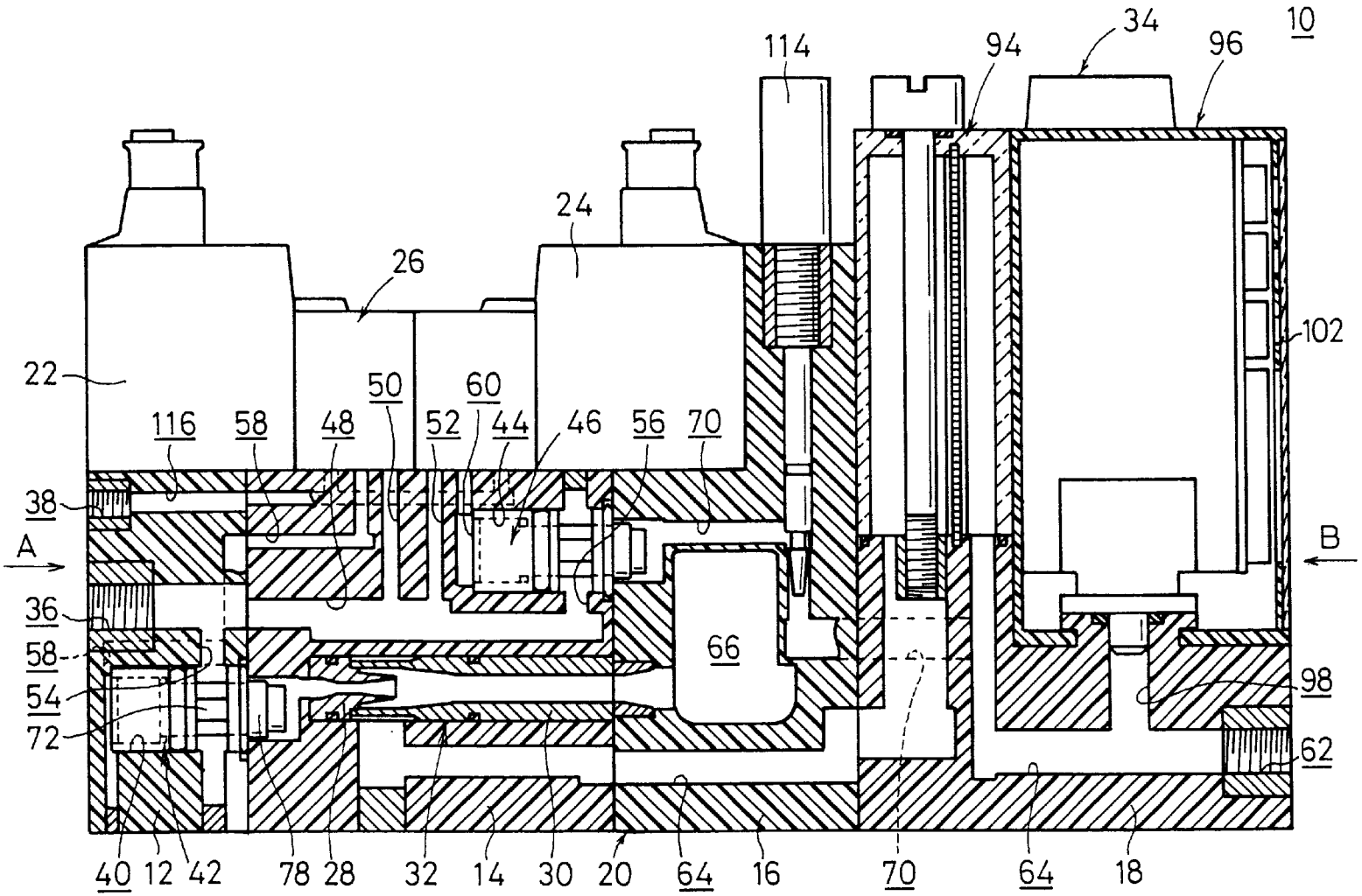
FIG. 1 shows a schematic longitudinal sectional view taken along an axial direction of a vacuum-generating unit according to an embodiment of the present invention.

The vacuum-generating unit 10 comprises a main body section 20 composed of a first block member 12, a second block member 14, a third block member 16, and a fourth block member 18 which are joined in series to one another in the longitudinal direction; a solenoid-operated valve section 26 composed of a pressure fluid-supplying solenoid-operated valve 22 and a vacuum-breaking solenoid-operated valve 24 which are arranged on upper surface portions of the main body section 20; an ejector section 32 which is arranged at the inside of the main body section 20 and which has a nozzle 28 and a diffuser 30; and a detecting section 34 which is installed to the fourth block member 18 for confirming an attraction state of a workpiece. The nozzle 28 may be formed integrally with the second block member 14. The pressure fluid-supplying solenoid-operated valve 22 and the vacuum-breaking solenoid-operated valve 24 are composed of the same constitutive components respectively, and each of them is designed as one of the normally closed type. The pressure fluid-supplying solenoid-operated valve 22 and the vacuum-breaking solenoid-operated valve 24 are not limited to those of the normally closed type. It is also allowable to use, for example, an unillustrated normally open type solenoid-operated valve, a self-holding type solenoid-operated valve, or a timer-equipped solenoid-operated valve.

Figure 2:
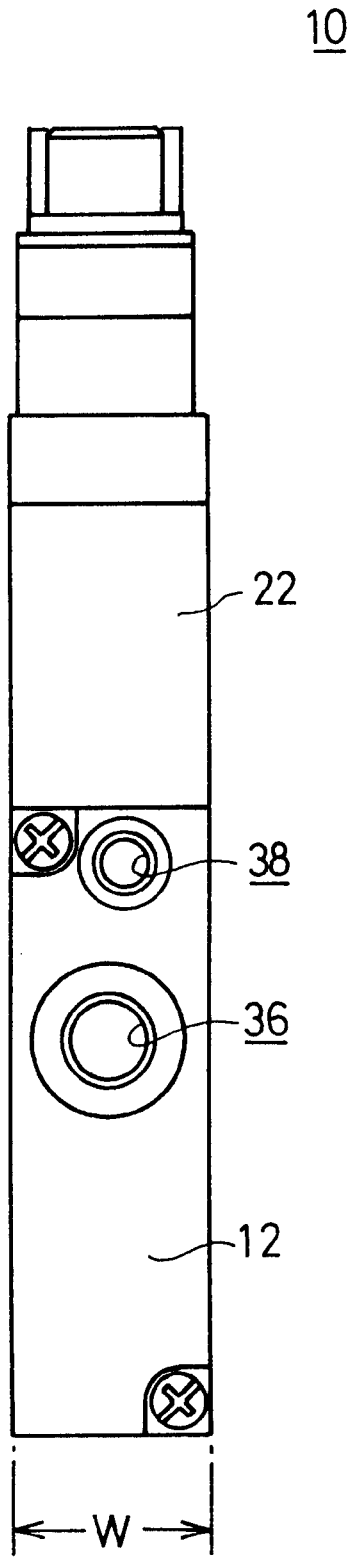
FIG. 2 shows a view as viewed in a direction indicated by an arrow A shown in FIG. 1.
Figure 3:
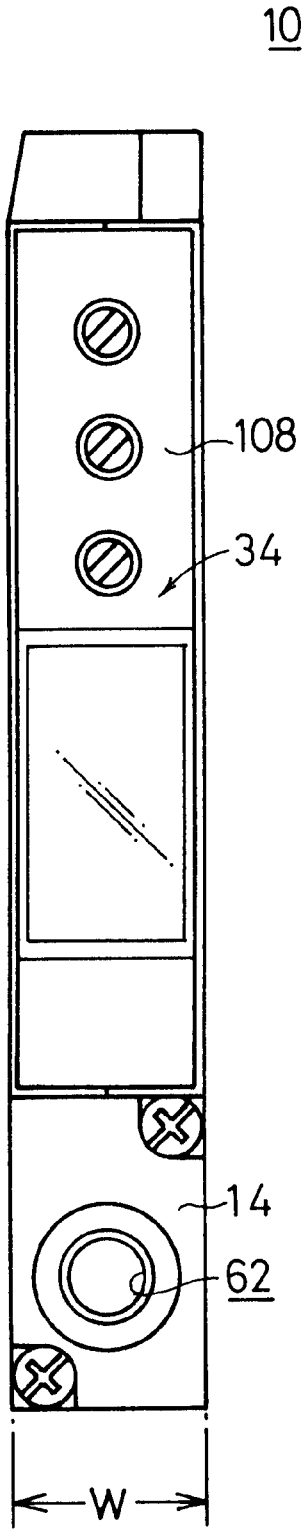
FIG. 3 shows a view as viewed in a direction indicated by an arrow B shown in FIG. 1.

The first to fourth block members 12, 14, 16, 18 have substantially the same widthwise dimension respectively, and each of them is formed to have a flat thin-walled configuration (see FIGS. 2 and 3). A compressed air supply port (pressure fluid supply port) 36, which is used to supply the compressed air to the ejector section 32, is formed on a first side surface of the first block member 12. An air discharge port 38 for the solenoid-operated valve is formed at an upper side portion disposed closely to the compressed air supply port 36. A first ON/OFF valve 42, which is switched from the OFF state to the ON state in accordance with the action of the supply of the pilot pressure, is arranged in a chamber 40 of the first block member 12. A second ON/OFF valve 46, which is switched from the OFF state to the ON state in accordance with the action of the supply of the pilot pressure, is arranged in a chamber 44 of the second block member 14.

The compressed air supply port 36 communicates with a first passage 48 which extends by a predetermined length along with substantially central portions of the first block member 12 and the second block member 14. A second passage 50 communicating with the pressure fluid-supplying solenoid-operated valve 22 and a third passage 52 communicating with the vacuum-breaking solenoid-operated valve 24 are formed, each of which is branched from the first passage 48 in a substantially perpendicular direction.

A fourth passage 54 communicating with the first ON/OFF valve 42 and a fifth passage 56 communicating with the second ON/OFF valve 46 are formed, each of which is branched from the first passage 48 in a substantially perpendicular direction. The compressed air is supplied to the first ON/OFF valve 42 and the second ON/OFF valve 46 via the fourth passage 54 and the fifth passage 56 respectively.

A first pilot passage 58, which is used to supply the pilot pressure to the first ON/OFF valve 42 by operating the pressure fluid-supplying solenoid-operated valve 22 to be turned ON, is formed between the pressure fluid-supplying solenoid-operated valve 22 and the first ON/OFF valve 42. A second pilot passage 60, which is used to supply the pilot pressure to the second ON/OFF valve 46 by operating the vacuum-breaking solenoid-operated valve 24 to be turned ON, is formed between the vacuum-breaking solenoid-operated valve 24 and the second ON/OFF valve 46.

Figure 7:
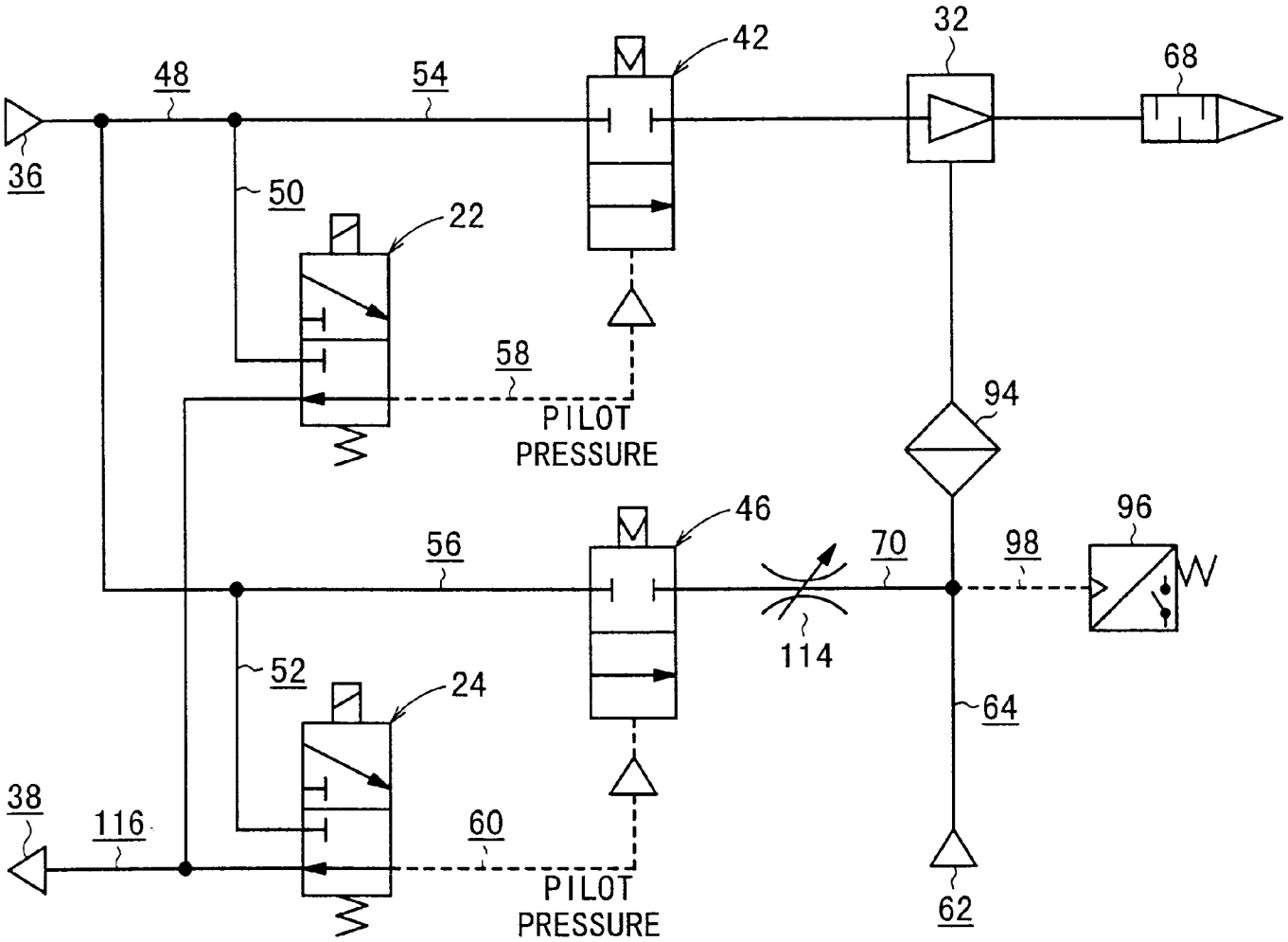
FIG. 7 shows a circuit system of the vacuum-generating unit shown in FIG. 1.

A sixth passage 64, which communicates with a vacuum port 62 and which extends substantially in parallel to the first passage 48, is formed between the diffuser 30 and the nozzle 28 for constructing the ejector section 32. The negative pressure, which is generated in the ejector section 32, is supplied to an unillustrated suction means such as a suction pad connected via a tube or the like. The diffuser 30 communicates with an air discharge port 66 which is formed in the third block member 16. The compressed air, which is supplied to the ejector section 32, is discharged to the outside via a silencer 68 (see FIG. 7) which communicates with the air discharge port (discharge port) 66.

A seventh passage 70, which communicates with the sixth passage 64 and which extends substantially in parallel, is connected to the second ON/OFF valve 46. When the second ON/OFF valve 46 is in the ON state, the compressed air is supplied via the seventh passage 70. Therefore, the negative pressure state is canceled by supplying the compressed air (positive pressure) to the sixth passage 64 which communicates with the vacuum port 62.

Figure 4:
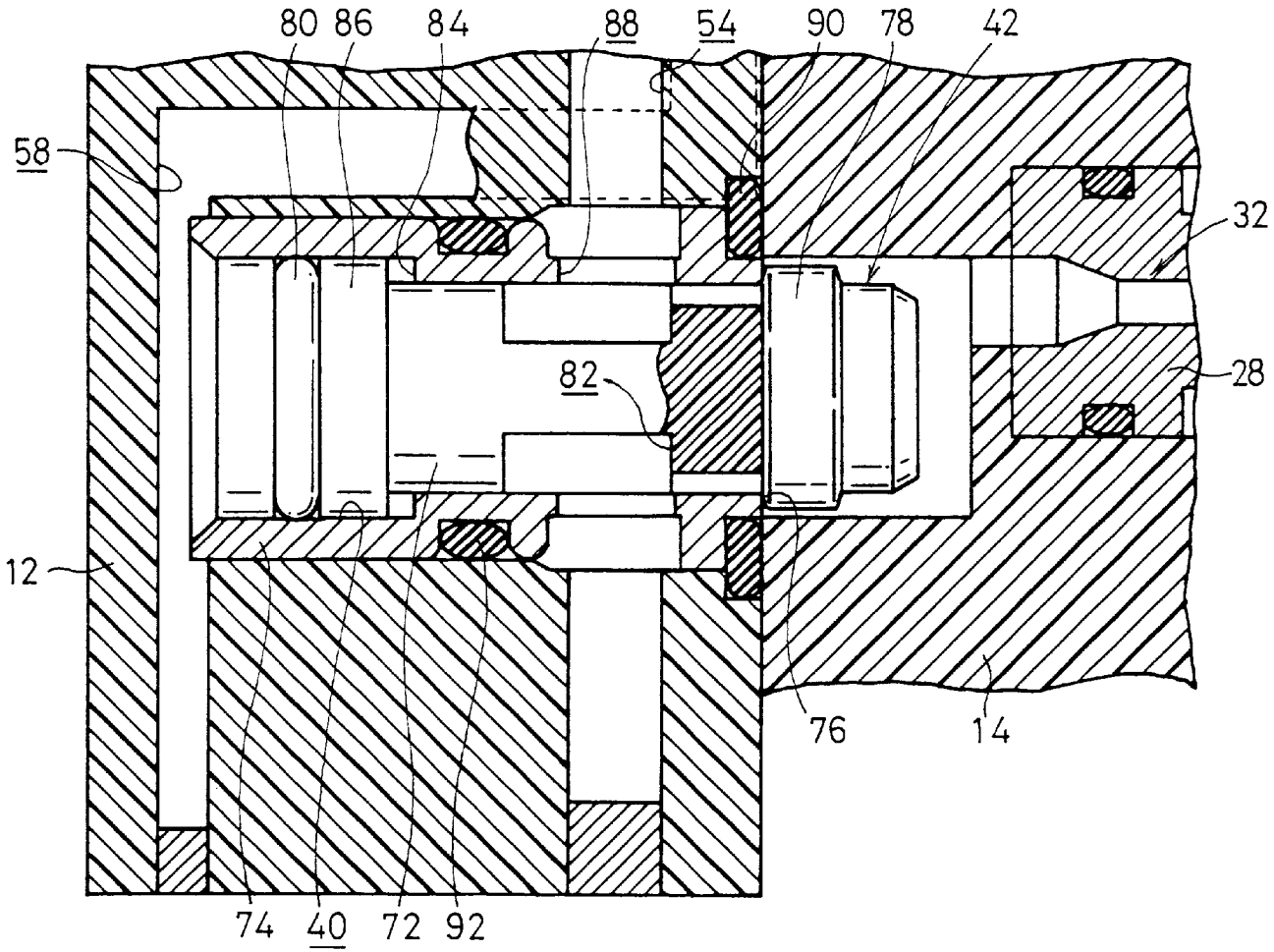
FIG. 4 shows a magnified longitudinal sectional view illustrating a first ON/OFF valve for constructing the vacuum-generating unit shown in FIG. 1.

The first ON/OFF valve 42 and the second ON/OFF valve 46 are composed of the same constitutive components respectively. As shown in FIG. 4, there are provided a valve plug 72 which is arranged displaceably by a predetermined distance substantially in the horizontal direction, and a retainer 74 which is formed to have a cylindrical configuration to surround the valve plug 72 and which is fixed in the chamber 40. A first ring member 78, which is seated on a seat section 76 of the retainer 74 to close the chamber 40, is installed to the outer circumferential surface of the valve plug 72 on a first side. A second ring member 80, which is slidable along the inner wall surface of the retainer 74, is installed to the outer circumferential surface of the valve plug 72 on a second side. Each of the first and second ring members 78, 80 is made of an elastic material such as natural rubber and synthetic rubber.

A stepped annular groove 82, which extends from a substantially central portion of the valve plug 72 to the first ring member 78, is formed for the valve plug 72. Further, a stopper section 86, which abuts against a step section 84 of the retainer 74 to regulate the displacement amount of the valve plug 72 in the rightward direction, is formed. A hole 88, which communicates with the stepped annular groove 82, is formed for the retainer 74. Reference numeral 90 indicates a packing, and reference numeral 92 indicates an O-ring.

Figure 5:
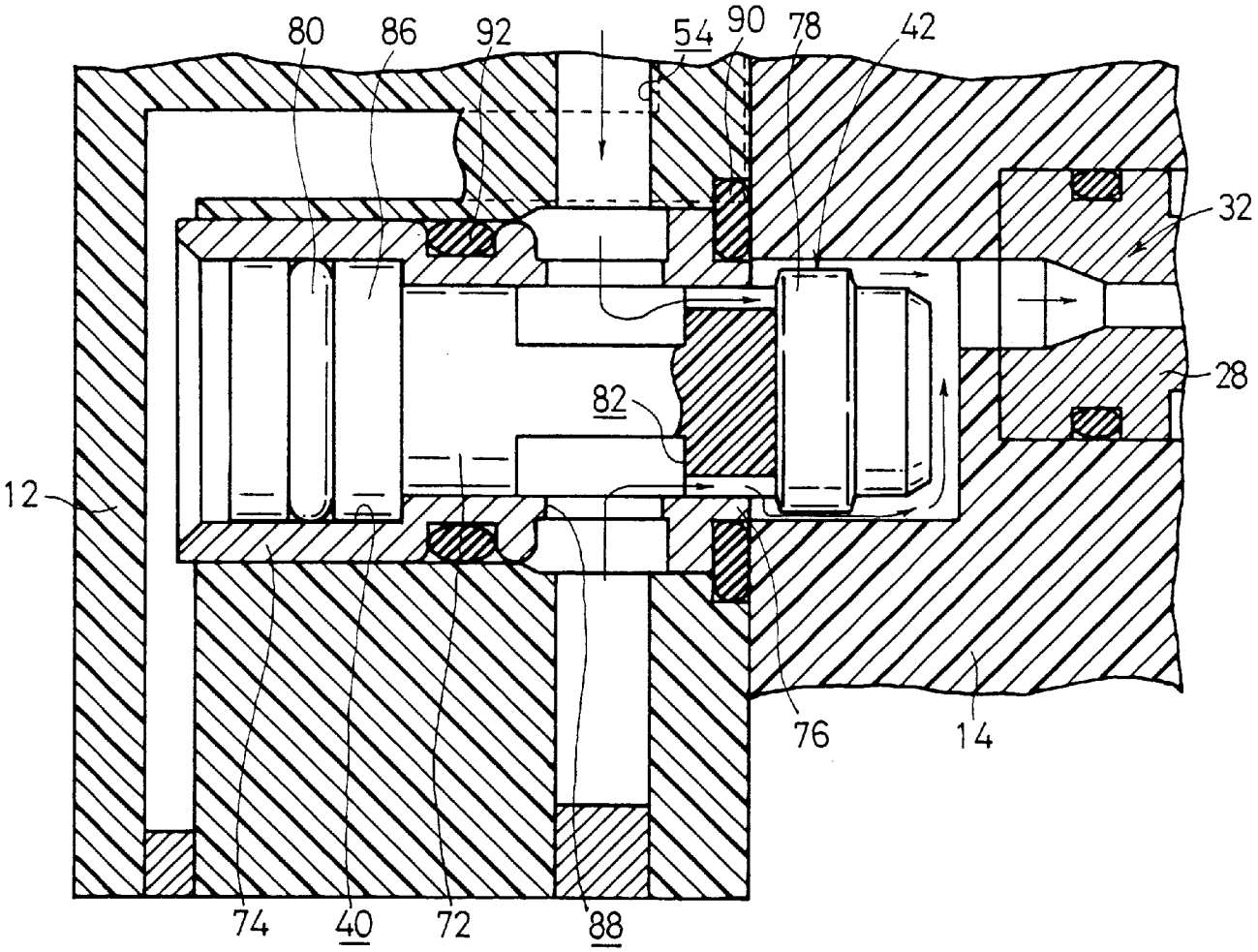
FIG. 5 illustrates the operation to be performed when a valve plug of the first ON/OFF valve shown in FIG. 4 is displaced in the rightward direction to give an ON state.

The valve plug 72 is displaced in the leftward direction as shown in FIG. 4 in accordance with the action of the compressed air supplied via the fourth passage 54. The first ring member 78 is seated on the seat section 76 of the retainer 74, and thus the chamber 40 is closed. As a result, the first ON/OFF valve 42 is in the OFF state. On the other hand, the valve plug 72 is displaced in the rightward direction as shown in FIG. 5 by the aid of the pilot pressure supplied via the first pilot passage 58 in accordance with the operating action of the pressure fluid-supplying solenoid-operated valve 22. The first ring member 78 is separated from the seat section 76, and thus the first ON/OFF valve 42 is in the ON state. In this arrangement, the compressed air, which is supplied via the fourth passage 54, is derived to the ejector section 32 via the stepped annular groove 82 and the space between the first ring member 78 and the seat section 76 as shown by arrows in FIG. 5.

Therefore, when the first ON/OFF valve 42 is in the OFF state, the supply of the compressed air to the ejector section 32 is stopped. When the first ON/OFF valve 42 is in the ON state, the compressed air is supplied to the ejector section 32.

As shown in FIG. 1, the detecting section 34 includes a suction filter 94 which is used to remove dust or the like contained in the air drawn from the vacuum port 62 under the action of the negative pressure, and a vacuum pressure switch 96 which includes an unillustrated semiconductor pressure sensor arranged at the inside for deriving a detection signal upon arrival at a preset threshold value. The suction filter 94 and the vacuum pressure switch 96 are connected to the fourth block member 18 in an air-tight manner respectively.

The vacuum pressure switch 96 functions to confirm the attraction state of the workpiece by introducing the negative pressure supplied to the suction pad via a passage 98 communicating with the sixth passage 64, and detecting the introduced negative pressure of the pressure fluid by the aid of the unillustrated semiconductor pressure sensor. It is preferable that a filter (not shown) for protecting the unillustrated pressure sensor is provided in the passage 98. The operation means for the vacuum pressure switch 96 may be either one of the trimmer type (not shown) or one of the push type (not shown) including the up-button and the down-button.

Figure 6:
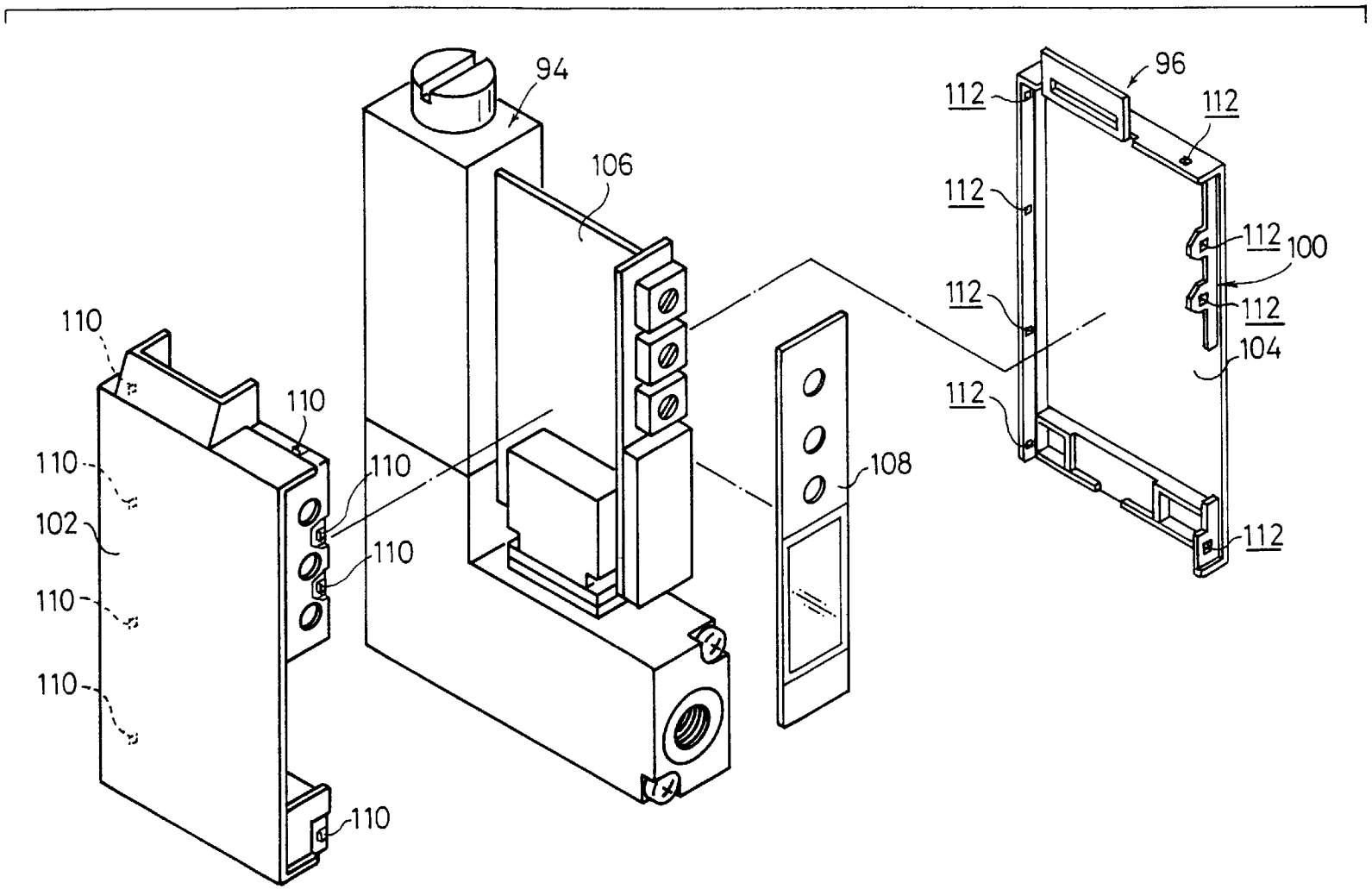
FIG. 6 shows an exploded perspective view illustrating a fastening means for a first casing and a second casing for constructing a vacuum pressure switch.

As shown in FIG. 6, the vacuum pressure switch 96 includes a first casing 102 and a second casing 104 which are integrally joined to one another by the aid of a fastening means 100, a circuit board 106 which is arranged in an internal space formed by the first casing 102 and the second casing 104, and a cover plate 108. The fastening means 100 comprises a plurality of projections 110 which are formed on a side wall surface of the first casing 102 in the vicinity of the opening, and fastening holes 112 which are formed on a side wall surface of the second casing 104 and into which the projections 110 are inserted.

In FIG. 1, reference numeral 114 indicates a flow rate-adjusting screw for adjusting the flow rate of the pressure fluid for breaking the vacuum, the pressure fluid flowing through the seventh passage 70, when the second ON/OFF valve 46 is in the ON state. Reference numeral 116 indicates an eighth passage for making communication between the air discharge port 38 for the solenoid-operated valve and the pressure fluid-supplying solenoid-operated valve 22 and the vacuum-breaking solenoid-operated valve 24 respectively. The eighth passage 116 is arranged so that it is substantially parallel to the first passage 48.

The vacuum-generating unit 10 according to the embodiment of the present invention is basically constructed as described above. Next, its operation, function, and effect will be explained on the basis of a circuit system diagram shown in FIG. 7. It is assumed that the pressure fluid-supplying solenoid-operated valve 22 and the vacuum-breaking solenoid-operated valve 24 are in the OFF state in the initial state respectively.

The compressed air, which is supplied from an unillustrated compressed air supply source, is introduced into the first passage 48 via the compressed air supply port 36. The compressed air, which is introduced into the first passage 48, is supplied to the chamber 40 of the first ON/OFF valve 42 which communicates with the first passage 48. The valve plug 72 is displaced in the leftward direction as shown in FIG. 4 in accordance with the action of the compressed air. The first ON/OFF valve 42 is in the OFF state.

In such a situation, the pressure fluid-supplying solenoid-operated valve 22 is in the ON state in accordance with the ON signal which is outputted from an unillustrated controller. At this time, the vacuum-breaking solenoid-operated valve 24 is still in the OFF state. When the pressure fluid-supplying solenoid-operated valve 22 is in the ON state, the pilot pressure is supplied to the first ON/OFF valve 42 via the first pilot passage 58. The valve plug 72 is displaced in the rightward direction in accordance with the pressing action of the pilot pressure, and thus the first ON/OFF valve 42 is in the ON state. When the first ON/OFF valve 42 is in the ON state, then the compressed air, which is introduced into the first passage 48, passes through the first ON/OFF valve 42, and it is supplied to the ejector section 32.

In the ejector section 32, the compressed air is jetted from the nozzle hole of the nozzle 28 toward the diffuser 30, and thus the negative pressure is generated. The negative pressure is supplied to the unillustrated suction pad via the sixth passage 64 and the tube which is connected to the vacuum port 62.

Therefore, the unillustrated suction pad contacts with the workpiece by operating an unillustrated robot arm. When the suction pad attracts the workpiece in accordance with the action of the negative pressure, the negative pressure is further increased. The negative pressure is detected by the unillustrated semiconductor pressure sensor of the vacuum pressure switch 96. The confirmation signal of the attraction, which is detected by the semiconductor pressure sensor, is fed to the unillustrated controller. When the controller receives the attraction confirmation signal, it is confirmed that the workpiece is reliably attracted by the suction pad.

Next, explanation will be made for a process in which the negative pressure of the suction pad is canceled to disengage the workpiece to a predetermined position after the workpiece is moved by a predetermined distance.

The unillustrated controller derives the OFF signal to the pressure fluid-supplying solenoid-operated valve 22. As a result, the pressure fluid-supplying solenoid-operated valve 22 is in the OFF state, and thus the first ON/OFF valve 42 is in the OFF state. The supply of the compressed air to the ejector section 32 is stopped, and the supply of the negative pressure from the vacuum port 62 to the suction pad is stopped.

On the other hand, the unillustrated controller derives the ON signal to the vacuum-breaking solenoid-operated valve 24 so that the vacuum-breaking solenoid-operated valve 24 is in the ON state. When the vacuum-breaking solenoid-operated valve 24 is in the ON state, the pilot pressure is supplied to the second ON/OFF valve 46 via the second pilot passage 60. The valve plug 72 is displaced in the rightward direction in accordance with the pressing action of the pilot pressure, and the second ON/OFF valve 46 is in the ON state. When the second ON/OFF valve 46 is in the ON state, then the compressed air, which is introduced into the first passage 48, passes through the second ON/OFF valve 46, and it is supplied to the vacuum port 62 via the second passage 70 and the sixth passage 64. As a result, the compressed air (positive pressure), which is supplied from the compressed air supply port 36, is supplied to the suction pad via the vacuum port 62. The attraction state, which is effected by the suction pad with respect to the workpiece, is canceled.

When the workpiece is disengaged from the suction pad, the state is changed from the negative pressure state to the atmospheric pressure state. The atmospheric pressure is detected by the unillustrated semiconductor pressure sensor. The semiconductor pressure sensor feeds the workpiece disengagement signal to the unillustrated controller. When the controller receives the workpiece disengagement signal, it is confirmed that the workpiece is disengaged from the suction pad. In this way, it is possible to reliably disengage the workpiece from the suction pad.

In the embodiment of the present invention, the first passage 48 communicating with the compressed air supply port 36, the sixth passage 64 communicating with the vacuum port 62, and the eighth passage 116 communicating with the air discharge port 38 for the solenoid-operated valve are arranged substantially in parallel to one another respectively. Further, the first ON/OFF valve 42 disposed on the lower side of the main body section 20 and the second ON/OFF valve 46 disposed on the upper side thereof are arranged substantially in parallel to the first passage 48 respectively. Further, in the embodiment of the present invention, the pressure fluid-supplying solenoid-operated valve 22, the vacuum-breaking solenoid-operated valve 24, the flow rate-adjusting screw 114, the suction filter 94, and the vacuum pressure switch 96 are successively carried in serious at the upper portions of the main body section 20 respectively.

The arrangement as described above in the embodiment of the present invention makes it possible to suppress the dimension of the main body section 20 in the widthwise direction substantially perpendicular to the axial direction and realize a small size and a light weight. Therefore, it is possible to effectively utilize the space in which the vacuum-generating unit 10 is installed.

Further, the embodiment of the present invention is advantageous in that the assembling operation can be conveniently performed by integrally joining the first casing 102 and the second casing 104 of the vacuum pressure switch 96 by means of the fastening means composed of the plurality of projections 110 and the fastening holes 112.

It is a matter of course that a plurality of individuals of the vacuum-generating units 10 according to the embodiment of the present invention are interlocked with each other to form a manifold.

What is claimed is:

1. A vacuum-generating unit comprising:

a main body section provided with a pressure fluid supply port connected to a pressure fluid supply source, a vacuum port connected to a suction means, and a discharge port for discharging, to the outside, a pressure fluid supplied from said pressure fluid supply port, wherein said main body section is composed of a first block, a second block, a third block and a fourth block which are connected end-to-end and joined in series in a longitudinal direction and each of which is formed to have a flat thin-walled configuration, and said first block, said second block, said third block, and said fourth block are formed to have a substantially identical widthwise dimension respectively;

an ejector section for generating a negative pressure in accordance with an action of said pressure fluid supplied from said pressure fluid supply port; and a solenoid-operated valve section and a detecting section carried on said main body section, wherein:

a passage communicating with said pressure fluid supply port extending through said first and second blocks, a passage communicating with said vacuum port extending through said second and third blocks, and a passage communicating with an air discharge port extending through said first and second blocks for a solenoid-operated valve are arranged substantially in parallel respectively.

2. The vacuum-generating unit according to claim 1, wherein a pressure fluid-supplying solenoid-operated valve, a vacuum-breaking solenoid-operated valve, a flow rate-adjusting screw, a filter, and a vacuum pressure switch are successively arranged in series in said main body section.

3. The vacuum-generating unit according to claim 1, wherein a first ON/OFF valve and a second ON/OFF valve are arranged substantially in parallel to said passage communicating with said pressure fluid supply port, said first ON/OFF valve is switched from an OFF state to an ON state in accordance with an action of a pilot pressure supplied from a pressure fluid-supplying solenoid-operated valve, and said second ON/OFF valve is switched from an OFF state to an ON state in accordance with an action of a pilot pressure supplied from a vacuum-breaking solenoid-operated valve.

4. The vacuum-generating unit according to claim 2, wherein said vacuum pressure switch includes a first casing and a second casing, and said first casing and said second casing are assembled to one another by inserting a plurality of projections formed on said first casing into a plurality of fastening holes formed in said second casing respectively.

5. The vacuum-generating unit according to claim 3, wherein each of said first ON/OFF valve and said second ON/OFF valve is composed of identical constitutive components including a valve plug which is provided displaceably by a predetermined distance in a substantially horizontal direction, a retainer which is formed to have a cylindrical configuration to surround said valve plug and which is fixed in a chamber, a first ring member which is provided on a first end side of said valve plug and which is seated on a seat section of said retainer to close said chamber, and a second ring member which is provided on a second end side of said valve plug and which is slidable along an inner wall surface of said retainer.

* * * * *